US005765927A

United States Patent [19]

Lewis, Jr.

[11] Patent Number: 5,765,927

[45] Date of Patent: Jun. 16, 1998

[54] METHOD OF FUSING NYLON FILAMENT TO NYLON BLOCK

[75] Inventor: John C. Lewis, Jr., Salisbury, Vt.

[73] Assignee: Tucel Industries, Inc., Forest Dale, Vt.

[21] Appl. No.: 785,224

[22] Filed: Jan. 17, 1997

Related U.S. Application Data

[63] Continuation-in-part of Ser. No. 540,504, Oct. 10, 1995, Pat. No. 5,678,899.

[51] Int. Cl.[6] ..... A46D 1/04

[52] U.S. Cl. ..... 300/21

[58] Field of Search ..... 300/2–11, 21; 264/243

[56] References Cited

U.S. PATENT DOCUMENTS

| | | | |
|---|---|---|---|
| Re. 27,455 | 8/1972 | Lewis, Jr. . | |
| 3,471,202 | 10/1969 | Lewis, Jr. . | |
| 3,604,043 | 9/1971 | Lewis, Jr. . | |
| 3,641,610 | 2/1972 | Lewis, Jr. . | |
| 4,255,224 | 3/1981 | Lorenz . | |
| 4,637,660 | 1/1987 | Weihrauch . | |
| 4,693,519 | 9/1987 | Lewis, Jr. . | |
| 4,907,841 | 3/1990 | Kay et al. | 300/21 |
| 4,968,103 | 11/1990 | McNab et al. | 300/21 |
| 5,224,763 | 7/1993 | Dirksing . | |
| 5,538,328 | 7/1996 | Lewis, Jr. . | |

*Primary Examiner*—Mark Rosenbaum
*Attorney, Agent, or Firm*—Donald C. Casey, Esq.

[57] ABSTRACT

A process is described for providing a tufted construction consisting entirely of nylon material wherein at least on tuft is joined to a brush block by fusion thereof. According to the process of this invention a non-working end of said tuft is fused simultaneously with a tuft receiving portion of said block and the two are joined immediately whereby the products fuse and cool before degradation of products in substantial amounts can be formed. The heat applied to fuse said materials is at least 350° F. over the melting point and the duration of time from application of heat to fusion jointer is less than 3 seconds.

11 Claims, 2 Drawing Sheets

METHOD OF FUSING NYLON FILAMENT TO NYLON BLOCK

CROSS-REFERENCE TO RELATED APPLICATION

This application is a continuation-in-part of my patent application Ser. No. 08/540,504, filed Oct. 10, 1995, now U.S. Pat. No. 5,678,899, issued Oct. 21, 1997, an assigned to the assignee of this application.

FIELD OF THE INVENTION

This invention relates to an improvement in the manufacturing of fused brushware products that are comprised only of synthetic monofilament tufts on a synthetic block or base. Specifically the invention relates to the fusing of nylon monofilament directly to nylon block or base to form, in mass production, durable brushware products.

DESCRIPTION OF THE PRIOR ART

Many different types of fused products and methods for constructing these products have been developed over the years and described in U.S. patents assigned to the assignee of this invention. Examples are U.S. Pat. Nos. 3,604,043; 3,471,202; Re. 27,455; 3,641,610; 4,255,224 and 4,693,519 among others. These patents describe fusing both like and different synthetic materials to each other to form tufted constructions. The patents, however, do not describe or teach fusing nylon to nylon. Prior to this invention, attempts to fuse nylon to nylon were unsuccessful because the nylon synthetic material decomposes when melted and the decomposition products interfere with the formation of a fusion bond between tufts and block, and also tend to deposit on the melter block forming a build up of residue which interferes with the fusing process.

In U.S. Pat. Nos. 4,637,660 and 5,224,763 there is described a process for bringing together nylon filament in groups of tufts which are fused at their bases on non-working ends. They are mounted on molded polypropylene substrates to form toothbrushes. However, the mounting method is a physical means for holding the individual tufts into the molded polypropylene substrate.

In U.S. Pat. No. 5,538,328 assigned to the assignee of this invention there is described the fusing of monofilaments to cellulose substrates. However, there is no chemical or fusion bond of the materials described in that patent either. In effect, a fused bulbous non-working end of filament tufts is forced into an open hole in the block and the method is similar to planting a tree in the ground.

Accordingly, there has been disclosed in the prior art no commercial method for fusing nylon brush products wherein tufts of monofilament are fused onto a base so that upon cooling an integral product will be formed.

SUMMARY OF THE INVENTION

It has been discovered, however, that nylon or polyamide oriented filaments and/or molded constructions can be successfully fused on a commercial scale. These materials have extremely high melting points. As is well known, the nylon molecule is made up of repeated amide groups (CONH), which melt at a specific temperature without significant softening prior to reaching that temperature. For example, the product nylon 610 has a melting point of 485° F. When it reaches that temperature it changes state. If it is changing from a solid to a liquid, it reacts with oxygen in the ambient atmosphere to form decomposed segments of the nylon polymer chain after it reaches its melting point. This creates a fused mass including chemical impurities in the melted nylon which impurities block a fusion bond between tuft and base.

The following are commonly available nylon (polyamide) products available, for example, from E. I. DuPont, de Nemours and Co., Inc. of Wilmington, Del. The numerals below denote preferred nylon grade names:

TYPES OF NYLON (POLYAMIDES)

| TYPE | MELTING POINT | SPECIFIC GRAVITY | WATER ABSORPTION |
|---|---|---|---|
| Nylon 6 | 410° F. | 1.14 | 9% |
| Nylon 66 | 495° F. | 1.14 | 9% |
| Nylon 610 | 485° F. | 1.07 | 7% |
| Nylon 612 | 410° F. | 1.06 | 3% |

At the high temperatures of the above melting points it is difficult to work the materials because an increase in temperature of a single degree over the melt point causes the material to react rapidly with ambient elements. Likewise, if the temperature drops even a single degree below the melting point, the mass solidifies immediately. This difficulty occurs because nylon does not exhibit a wide range of temperature sensitivity, and in fact, as noted above little softening occurs below the melting point temperature.

In contrast, other polymers such as polyethylene and polypropylene exhibit softening over a wide range of temperatures up to the melt point, and therefore controlling fusion thereof is relatively easy.

In addition to the above processing problems nylon contains moisture at room temperature, and thus, when the nylon material reaches the boiling point of water, the water therein will vaporize. When the nylon material fuses, then water vapor will be immediately expelled as the surface tension diminishes.

It has been discovered, however, that both nylon filament tufts and nylon block can be fused if (a) they are simultaneously liquefied by fusion, (b) the minimum oxygen is present to minimize decomposition of the melted product, and (c) the two fused components are brought together as quickly as possible, and preferably in a time period of less than a second.

By positioning the assembled thermoplastic polyamide filament tufts in close proximity to a molded polyamide substrate, and simultaneously controlling the temperature and the melting time of the two, when they are brought together in less than 0.25 seconds, a complete chemical bond between the tufts and substrate is achieved with negligible decomposition of the polyamide material. The resulting structure has all the physical, chemical and cosmetic properties of an integral nylon product.

DEFINITIONS

The term "fusedware" and similar terms used herein refer to a tufted device, either brush or broom, having both synthetic filament tufts and a molded base fabricated from a thermal plastic polyamide resin wherein the non-working ends of the tufts are fused integrally with the base.

The term "nylon" means any polyamide type material including single and double monomer types. "Nylon" filament as used hereinafter includes filaments which are formed from linear thermoplastic polyamides. Both oriented and un-oriented filaments may be employed. Also, various filament cross-sections may be used such as, for example, circular, lobular, trifoil, X and Y cross-sections, and triangular, polygonal, star-shaped cross-sections, and the like. Mixtures of synthetic filament may be employed in cases where the compositions of the filaments are compatible during any fusing operations such as heat sealing. Such filaments may have suitable crimp imparted to their length or a portion thereof. Filaments may contain organic or inorganic modifications in order to make them biodegradable, or to cause them to decompose over a given period of time.

The term "picking" as used herein refers to the formation of filament tufts wherein one or more tufts are formed simultaneously by longitudinally engaging more than one cut-to-length filament at its end and removing said filament from a parallel disposed bundle of filaments. Picking devices are employed in my prior U.S. Pat. Nos. 3,471,202; 3,910,637; 4,009,910, and 4,109,965, among others.

Accordingly it is an object of this invention to provide a new and useful tufted polyamide (nylon) product made by fusing tufts to a block of substrate.

It is another object of this invention to provide a fused, high heat nylon brush having improved qualities by placing synthetic polyamide filament tufts on the surface of a molded polyamide substrate in order to provide a heat resistant nylon brush will not melt or be effected by heat during grilling or in a conventional food preparation oven.

It is another object of this invention to provide a fused nylon brush construction wherein the filament does not pull off the molded block during use as is the case of nylon filament in an epoxy-set paint brush construction.

It is still another objection of this invention to provide novel brush constructions of fused nylon components on a commercial scale without associated degradation product buildup on the machinery.

These and other objects will become readily apparent with reference to the drawings and following description wherein:

DETAILED DESCRIPTION OF THE INVENTION

For the purposes of providing nylon tufted constructions using nylon filament on a nylon back or substrate a pre-dried product is used. This means that the product is dried using conventional techniques to about 1–2% moisture.

Figure 1:
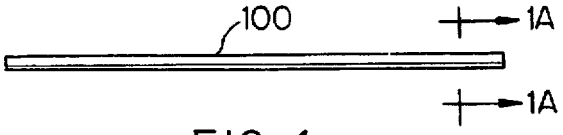
FIG. 1 is a side view of a tuft of monofilaments.
Figure 1A:
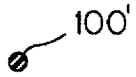
FIG. 1*a* is a cross-sectional view taken along lines A—A of FIG. 1.

Referring to FIG. 1 there is shown a conventional tuft of nylon filaments 100 having a working end 100' and a non-working end 100". The non-working end is defined as the end which would be mounted on a block or substrate.

Figure 2:
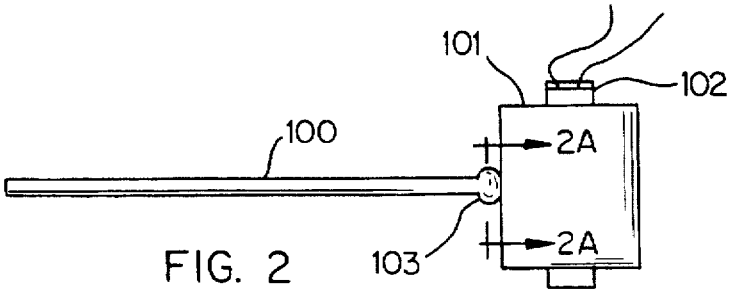
FIG. 2 is a schematic side view showing a tuft of monofilaments being fused at an end.

With attention to FIG. 2, if the non-working end 100" of tuft 100 is translated into the heated surface of a conventional heater block 101 having a cartridge heater 102 for a heat source, the end of the tuft will form a melted, fused mass 103 of the filamentary material.

Nylon has a relatively high melting point, and, for example, in the case of conventional nylon type 66 the melting point is 495° F. Nylon becomes liquid at its melting point temperature, but as it is heated to that temperature is undergoes very little softening until it reaches the precise melting point. Furthermore, nylon is a long chain polymer, and when it melts at that relatively high temperature, the chains break down and reactions occur primarily with ambient atmospheric oxygen to form degradation products. Therefore, when the melted tuft end 103 cools, the degradation products will be present and the melt will not return to its previous long chain condition. In other words, when nylon melts in atmospheric oxygen, a chemical reaction immediately occurs which is irreversible.

If the fusing techniques used in my above identified patents assigned to the assignee of this invention are used, the degradation products formed will militate against a fusion bond between a nylon tuft of filaments and a nylon brush block or other substrate. When the items cool, they will not intermix to any substantial degree because of the presence of the degradation products, and therefore the tuft will pull out away from the block. A durable product then using prior art techniques could not be made.

In addition, when using my prior processes wherein a plurality of tufts of filaments are picked and then simultaneously melted at their non-working ends, if those filaments were nylon, or a nylon block was used, immediately after removing the melting device from the melted nylon it was necessary to scrape the charred degradation products from the surface before proceeding with the next fusing additional products. The oxidation and degradation products of fusion of nylon attach to the surface of the heater, and thereby make automatic production impossible.

Figure 2A:
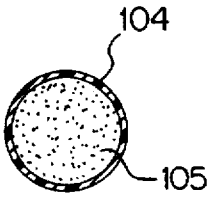
FIG. 2*a* is a cross-sectional view taken along lines B—B of FIG. 2.

As shown in FIGS. 2 and 2*a*, the tuft 100 which, for example, is nylon 66 is melted by abutting its non-working end against the heater block 101 to form the melted mass 103. However, with reference to FIG. 2*a*, the center section 105 of the melted mass 103 remains pure nylon material whereas the degradation products form a coating 104 on the outer surface of the fused end only.

Figure 3:
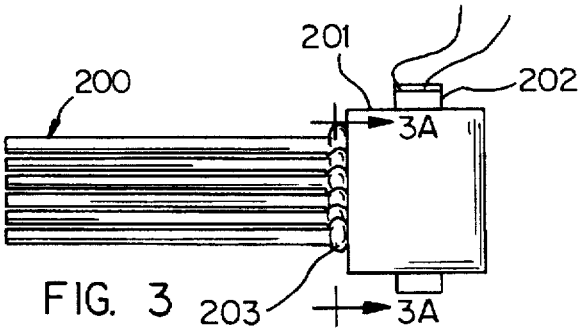
FIG. 3 is a side view similar to FIG. 2 showing a plurality of tufts being simultaneously fused at an end.
Figure 3A:
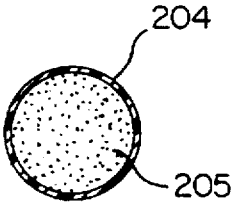
FIG. 3*a* is a cross-sectional view taken along lines C—C of FIG. 3.
Figure 4:
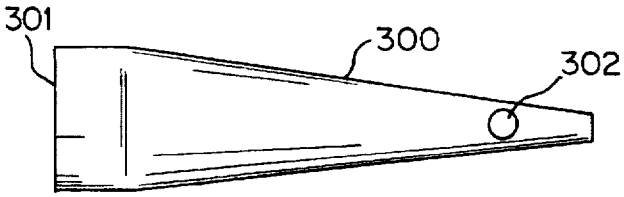
FIG. 4 is a side view of a brush block of nylon.
Figure 4A:
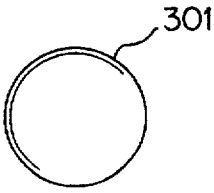
FIG. 4*a* is an end view of a brush block of FIG. 4.

With attention to FIGS. 3 and 3*a*, if a larger product is used such as a plurality of monofilament tufts wherein, for example, each tuft has a diameter of 0.375" in each nylon filament has a diameter of 0.009" it has been discovered that there is little oxidation at the point of fusion 203 of the tuft 200 when it is melted against the heater block 201 using a cartridge heater 202. As shown in FIG. 3*a*, the middle of the mass remains pure nylon 205 whereas the contamination is only on the outer surface 204. This illustration, however, refers to the condition of the melted mass almost immediately after melting, for up to about 1.5 seconds.

Figure 5:
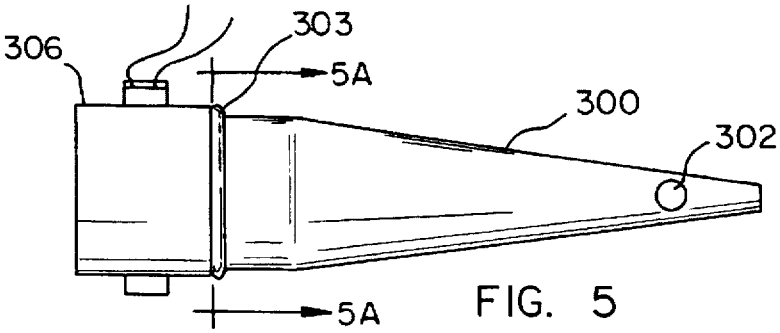
FIG. 5 is a side schematic view of the brush block of FIG. 4 having an end melted.
Figure 5A:
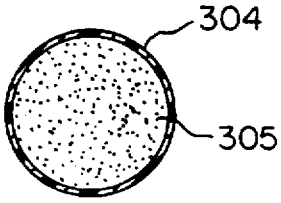
FIG. 5*a* is a cross-sectional view taken along lines D—D of FIG. 5.

With attention to FIG. 4, 4*a*, 5, and 5*a*, the same phenomenon occurs when a nylon molded construction is melted. For example, there is shown a nylon type 6 block 300 having a hang up hole 302 at an end thereof and a filament receiving end 301. As shown in FIG. 5 and 5*a*, when the nylon block 300 is brought into contact at position 303 on heating block 306 there is a melting of the end 301 to form a melted mass 303. As shown at FIG. 5*a*, however, the center portion 305 remains pure melted nylon whereas the degradation products occur only on the outer surface 304.

Figure 6:
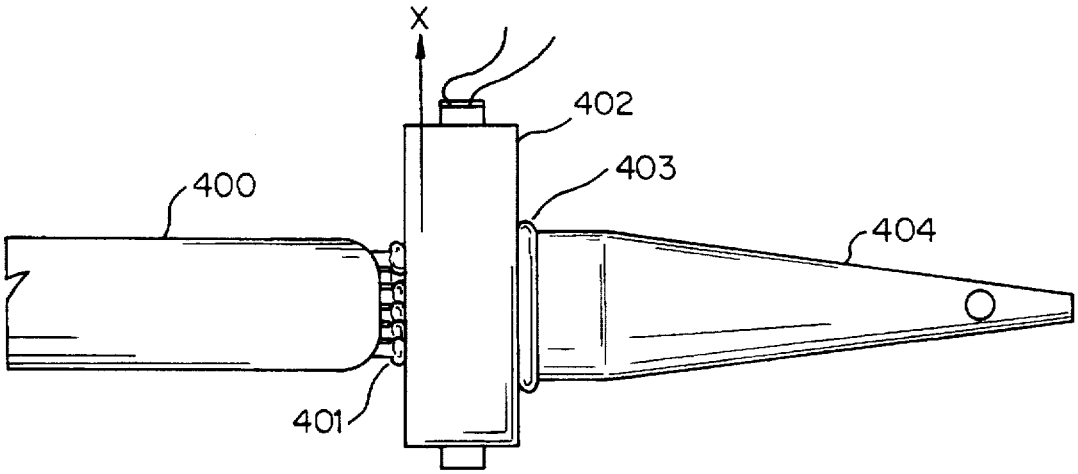
FIG. 6 is a side schematic view showing a plurality of tufts being fused and a brush block being heated to melt an adjacent face thereof.

It can be shown by first picking a plurality of tufts each having a diameter of 1.0" and contained in a tuft picker 400 as shown in FIG. 6 the non-working ends 401 of the picked tufts and the molded end 403 of a nylon type 6 block 404 can be placed in registration with each other and simultaneously brought into contact with a heater 402. This will form at the plurality of tufts, a melted mass 401, and at the brush block 404 a melted mass 403.

It must be emphasized that when FIG. 6 is depicted as having the picked tufts and the block in registration, it is meant that the longitudinal axes thereof coincide.

Figure 7:
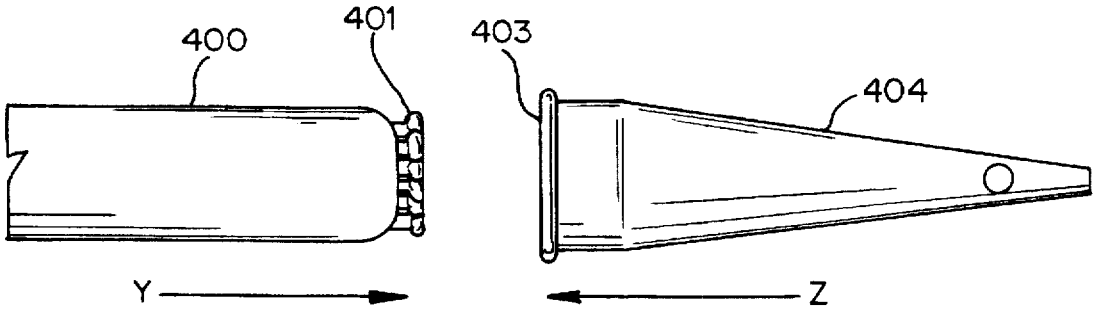
FIG. 7 is a side view similar to FIG. 6 with the heater removed.
Figure 8:
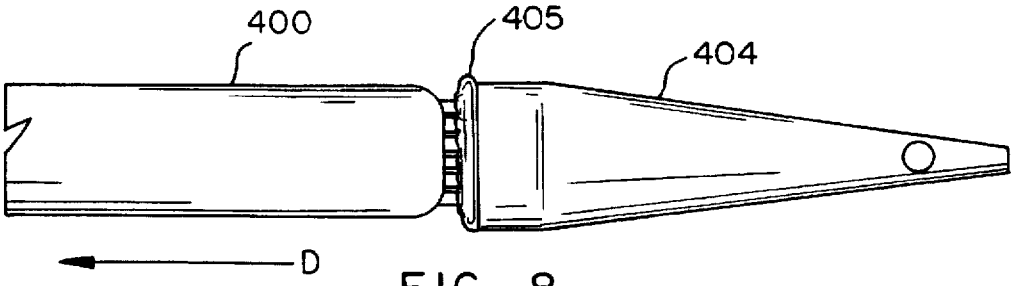
FIG. 8 is a side view showing the tufts and brush block of FIG. 7 fused together.
Figure 9:
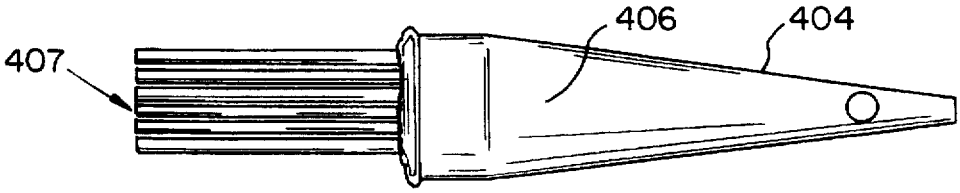
FIG. 9 is a side view similar to FIG. 8 wherein the tuft picker has been removed after cooling.

It has been discovered that if the fusing occurs against a heater block which is at a temperature very substantially elevated above the melting temperature of the nylon, and if the melting occurs almost instantaneously so that the fused ends can be joined immediately, the melted mass will not degrade enough to interfere with the bond between the picked tufts and the block or substrate. By elevated temperature it is meant that the temperature of the heated surface is about 1000° F., and that the melting occur at about ½ second., for best results with nylon. The fusing together then of the melted masses will result in a freezing or solidification of the melted nylon and the joining thereof. As shown in FIG. 7, the picker 400 which has tufts joined by melted mass 401 is translated in the direction Y whereas the brush block 404 with the melted face 403 is translated in the direction of Z and as shown in FIG. 6, the heater 402 is removed from between the two by translation in the direction of X. The two fused masses are then joined together as shown in FIG. 8 to form a common mass 405 and after 4 or 5 seconds, mass 405 has cooled sufficiently so that the picker can be translated in the direction D and removed from the tuft to form the tufted construction 406 shown in FIG. 9 having working ends 407 extending from the brush block 404.

It is possible to mix different types of nylon for the filament and the brush block and in most cases this presents no problem. In the case of type 6 nylon, however, the single monomeric molecule, caprolactam, is always present and therefore to avoid degradation products, temperature control must be precise, and the products must be joined as quickly as possible. When this occurs, satisfactory products can be produced with a mixture of type 6 and other conventional nylon products.

It is essential to the process of this invention then that pre-dried nylon be used having a 1–2% moisture content, that the fusing occur at a temperature elevated at least 350° F. above the melting point, and that the products be melted and joined in less than about 3 seconds. In a preferred embodiment, a temperature of 1000° F. is used for the melting, and the fused masses are melted and joined in 0.5 seconds.

As noted above, the decomposition and immediate build up of residue from the nylon as it melts on the melter device at temperatures of 800°–1000° F. is what has prevented fusing of nylon to nylon in the past. The prior art did not contain a means for fully automating such a fusion process due to the fact that each time a tuft of nylon filaments or nylon block is melted, immediately after removing the melting device one must spend upwards to 2–3 minutes scraping off the melted, charred residue before being able to proceed with the next fusing of additional product. In the instant invention, however, by limiting the process to a time frame of less than 3 seconds, it has been discovered that the process can be automated in that a significant deposit of decomposition materials does not occur. In other words, by combining the elevated temperature and a shortened time for the overall process of fusing and joining, degradation products do not form on the heated block of the melter device.

In summary, then, a process for adjoining nylon tufts with a nylon substrate of brush block has been described herein wherein tufted constructions can be formed which are 100% nylon. Furthermore, these products can be formed in an automated fashion and exhibit desired durability due to the minimization of degradation products when the nylon is heated fused in an ambient atmosphere. The process of this invention utilizes temperature very substantially above the melting point of the nylon to achieve the fusion, and limits the time for fusing and joining to less than 3 seconds and preferably to about 0.5 seconds to form the products of this invention.

It will be readily seen by one of ordinary skill in the art that the present invention fulfills all of the objects set forth above. After reading the foregoing specification, one of ordinary skill will be able to effect various changes, substitutions or equivalents and various other aspects of the invention as broadly disclosed herein. It is therefore intended that the protection granted hereon be limited only by the definition contained in the appended claims and equivalents thereof.

I claim:

1. A process for forming a tufting construction of nylon synthetic material consisting of at least one tuft of nylon monofilaments fused at an end thereof to a nylon substrate comprising the steps of:

providing at least one tuft of nylon, cut to length monofilaments having a moisture content of less than about 1–2% and having a non-working end and a working end;

providing a nylon brush block having a moisture content of less than 1–2% and having a tuft receiving face;

orienting the tuft receiving face of said block and the non-working end of said tuft in a mutually spaced registered position wherein the non-working end is adjacent and spaced away from the tuft receiving face;

providing a melting means for fusing said tuft and block maintained at a temperature at least 350° F. above the melting point of said nylon and disposing said melting means adjacent said tuft and block;

melting the non-working end of said tuft and the tuft receiving face of said block, simultaneously, by exposing the same to said melting means, and bringing said non-working end of said tuft and tuft receiving face into contact in less than 3 seconds after first exposing said ends and face to said melting means, until cooling occurs, to fuse said non-working end of said tuft to said tuft receiving face whereby an integral fused tufted construction is formed.

2. The method of claim 1 wherein the nylon constituent of said tuft is different from the nylon constituent of said block and the temperature of said melting means is at least 350° F. above the lowest melting point of said nylon materials.

3. The method of claim 2 wherein said synthetic filament is comprises of nylon type 66 and the substrate is comprises of nylon type 6.

4. The method of claim 2 wherein the synthetic filament is comprises of nylon type 610 and the substrate is comprised of nylon type 6.

5. The method of claim 2 wherein the nylon of the synthetic filament tuft is nylon type 612 and the brush block is nylon type 6.

6. The method of claim 2 wherein both nylon constituents are type 6 nylon.

7. The method of claim 1 wherein said melting means is provided at a temperature of about 1000° F.

8. The method of claim 1 wherein the elapse time from exposing the non-working end of said tuft and said tuft receiving face to said melting means to contact therebetween is about 0.5 seconds.

9. The method of claim 1 wherein a plurality of said tufts are provided and each of said tufts has a non-working end, said plurality of tufts being disposed in predetermined pattern wherein the non-working ends are all contained within a plane and the non-working ends are all heated simultaneously with the tuft receiving face of said block.

10. The method of claim 9 wherein said melting means has a pair of opposed, heated faces and the plane containing the ends of said non-working tufts, and planes containing said heated faces are disposed parallel and adjacent a plane containing the tuft receiving face of said block whereby the non-working ends are subjected to heat from one of said parallel faces and the tuft receiving face is subjected to heat from the other of said faces and said melting means is disposed between said tufts and block.

11. The method of claim 10 further comprising the step of removing the melting means from between the melted non-working ends and melted tuft receiving face and translating the fused non-working ends of said tufts into contact with said fused tuft receiving face to join the same thereto.

* * * * *